United States Patent [19]

Günkinger et al.

[11] 4,313,299

[45] Feb. 2, 1982

[54] METHODS AND APPARATUS FOR CHANGING BOBBINS IN FLYER SPINNING FRAMES

[75] Inventors: Siegfried Günkinger, Heiningen; Hans-Peter Weeger, Hattenhofen; Kurt Kriechbaum; Wolfgang Igel, both of Ebersbach, all off, Fed. Rep. of Germany

[73] Assignee: Zinser Textilmaschinen Gesellschaft mit beschränkter Haftung, Ebersbach, Fed. Rep. of Germany

[21] Appl. No.: 71,505

[22] Filed: Aug. 31, 1979

[30] Foreign Application Priority Data

Sep. 2, 1978 [DE] Fed. Rep. of Germany ..... 2838398

[51] Int. Cl.[3] ..... D01H 9/04

[52] U.S. Cl. ..... 57/267; 57/277

[58] Field of Search ..... 57/266–268, 57/67–71, 276, 277

[56] References Cited

U.S. PATENT DOCUMENTS

| | | | |
|---|---|---|---|
| 1,752,678 | 4/1930 | Mackie | 57/267 |
| 2,541,503 | 2/1951 | Crossman et al. | 57/267 |
| 2,819,580 | 1/1958 | Teupel | 57/267 |
| 3,380,238 | 4/1968 | Araki et al. | 57/267 |
| 3,935,699 | 2/1976 | Iida et al. | 57/267 |
| 3,990,222 | 11/1976 | Marzoli | 57/267 |

*Primary Examiner*—John Petrakes

*Attorney, Agent, or Firm*—Edwin E. Greigg

[57] ABSTRACT

A method and apparatus for changing bobbins in a flyer spinning frame which includes a bobbin rail for supporting bobbins adjacent the flyers movable both vertically and tiltably, the bobbin rail being moved sequentially from an upper bobbin winding position, a lower horizontal position, a forwardly tipped position, then upwardly in the tilted position into a comfortable bobbin doffing position, downwardly into the lower position, back into a horizontal position while in the lower position then finally upwardly into the upper bobbin winding position.

8 Claims, 6 Drawing Figures

METHODS AND APPARATUS FOR CHANGING BOBBINS IN FLYER SPINNING FRAMES

BACKGROUND OF THE INVENTION

The invention relates to methods for changing bobbins in flyer spinning frames with stationary, rotatably suspended flyers and with bobbins rotatably supported in a bobbin rail which is movable up and down, wherein the bobbin rail, after the bobbins have been wound, is lowered into a position in which the bobbins are located outside the flyers and in which the bobbin rail is tipped forward in order to change the bobbins and then tipped back into the horizontal position after the bobbins have been changed and finally moved upward again into the initial position for resuming the bobbin winding process. The invention further relates to apparatuses for performing these methods.

On such machines as described above, in order to be able to pull the bobbins from the bobbin spindles, on which they are supported during their rotation, it is necessary to lower the bobbin rail and thus to move the bobbins outward out of the flyers. However, it requires a considerable exertion of force to lift the full bobbins, weighing several kilograms each, vertically upward by 40 to 50 cm from their lowermost position only a short distance above the floor and then to pull them horizontally outward in order to remove them from their bobbin spindles. This is particularly difficult in the case of the bobbin located in the rear bobbin row further away from the operator.

Thus, as noted above, it is already known to tip the bobbin rail forward when it is in its lowermost position, so that when the bobbins are pulled off they need no longer be lifted vertically upward but can instead be lifted by the operator toward his own body, which requires substantially less exertion of force. (See German Offenlegungsschrift No. 25 21 057.) However, even here, the operator must still bend over, and on lifting the bobbins must lift up not only the weight of the bobbins but also the weight of his own body each time as well. From the point of view of functional efficiency, this is very unfavorable.

OBJECTS AND SUMMARY OF THE INVENTION

It is accordingly a principal object of the present invention to provide a method and apparatus for exchanging or doffing full bobbins for empty tubes which is more favorable in terms of functional efficiency.

This object is attained by means of the method steps and apparatus of the invention wherein the bobbin rail is lowered after the bobbins have been filled. The bobbin rail is tipped forward at an angle and then raised where the full bobbins may be comfortably and easily removed and replaced by empty bobbins. It is not necessary in each case to lower the bobbin rail into its lowermost position. Instead, it is frequently sufficient to lower the bobbin rail, depending on the construction of the flyers, only to such an extent that tipping the bobbin rail is possible without the bobbin striking the flyer arms or the spring fingers. In the raised comfortable doffing position of the bobbin rail, the operator can pull off the full bobbins and place the empty tubes on the spindles without having to bend down or stretch. The heavy, filled bobbins are presented to the operator at a height and in a position which are efficient for grasping and can be pulled off with a short lifting path. The position of the bobbin spindles is equally favorable for subsequently placing the empty tubes thereon.

Once the empty bobbins are placed on the bobbin rail the bobbin rail is lowered, tipped back to its horizontal position and raised into place for filling the empty bobbins. This method requires a much less strenuous work day for the operator.

The method steps of the invention, from the point of stopping the machine after the bobbin winding is completed through the lifting of the bobbin rail into the position for removing the bobbins, may be made to begin and run their course automatically. In accordance with the invention, however, it is proposed to subdivide the essential method steps for bobbin changing into those which begin and run their course automatically and those which are initiated by the operator and then run their course automatically. As a result, for example, the bobbin rail is prevented, without the operator's supervision, from tipping outward into the service corridor and colliding with bobbin carriers or other obstructions. Accordingly, the automatic course of the various movements of the machine during bobbin changing is only interrupted when this is called for or advantageous in terms of the efficiency of the operation—that is, in order to tip the bobbin rail outward, to pull off the filled bobbins and place the empty tubes on the spindles, and to apply the roving threads onto the empty tubes. Subsequent to these occasions when the machine is stopped, the automatic method is again resumed, each time as a result of signals provided by the operator.

In a further embodiment of the method according to the invention, it is proposed to perform further necessary method steps, which are known in themselves, for changing bobbins on flyer spinning machines simultaneously with the first of the method steps of the invention.

In order that neither the flyer arms nor the spring fingers are in the way of the bobbin when the bobbin rail is moved upward, not only must the arms be brought to a stop in a position in which they hinder the action of pulling off the bobbins as little as possible, but also the spring fingers must be moved all the way inward toward the axis of the flyers. Apparatuses by means of which the arms can be brought to a stop in a predetermined position are known (see German Pat. No. 751,504). It has been demonstrated that the intended position of the spring fingers can be attained very easily and reliably by means of one of the method steps of the invention.

The apparatus for performing the method steps of the invention is derived from a flyer spinning frame of the general type described at the outset, which includes reversible-direction drive means for moving the bobbin rail upward and downward and a control apparatus with switching elements for influencing the drive means. This reversible-direction drive means, which is known in itself, is intended first for bringing about, in a manner which is also already known, the relative movement between the bobbins and the flyers required for building up the bobbin winding with parallel winding layers of gradually decreasing length. In addition, this drive means, again in a known manner, effects the lowering of the bobbin rail in order to move the bobbins out of the flyers and, after the bobbins have been exchanged, again raises the bobbin rail into the initial position for the beginning of the bobbin winding process.

Beyond these known features, the drive means in the present invention also effects the raising of the bobbin rail from its lowered position into the position for pulling off the bobbins and effects the subsequent relowering of the bobbin rail.

The drive means may be embodied in a conventional manner as a switchable reversing gear, which is driven by the primary motor of the spinning frame and moves the bobbin rail up and down by means of pinions which are disposed on longitudinal shafts and mesh with racks on vertically guided cantilevers supporting the bobbin rail. As a rule, in order to raise and lower the bobbin rail in connection with the exchange of bobbins, the drive means is drivable by an auxiliary drive when all the other elements of the spinning frame are stopped.

The movement up and down of the bobbin rail may also take place without the use of the reversing gear such as by means of an auxiliary motor whose rotary direction is reversible. However, the invention may also be carried out on flyer spinning frames by using a different lifting drive means, such as hydraulic piston/cylinder units.

In order to cause the spring fingers to move inward as mentioned above, the invention may include an inching device utilizing a button to be pressed, which can be activated by hand and by means of which the drive can be switched on at least for the flyers, causing the appropriate rotary movements and rotary hesitation movements and the necessary arrest and angular position of the flyers. In a preferred embodiment, the inching device is embodied as an automatic switching device, which upon actuation and in accordance with the initial position of the flyers automatically directs a surge of current of corresponding magnitude and/or duration onto the drive of the flyers, which causes the drive to effect the appropriate movement.

Tipping the bobbin rail outward and inward may be undertaken by the operator by hand, when suitable operating means are provided which permit unendangered actuation with a reasonable expenditure of time and force. However, a feature for accomplishing this in accordance with the invention is preferred. A number of known devices are suitable as functional elements, such as hydraulically or pneumatically actuated lifting or rotary elements, electromotors which either mesh by means of a pinion or a screw with a toothed segment disposed on the bobbin rail or rotate cams which effect the pivoting motion of the bobbin rail, and others. The invention also includes an entirely automatic pivoting of the bobbin rail.

The invention will be better understood as well as further objects and advantages thereof become more apparent from the ensuing detailed description of a preferred embodiment taken in conjunction with the drawings.

DESCRIPTION OF THE PREFERRED EMBODIMENT

Figure 1:
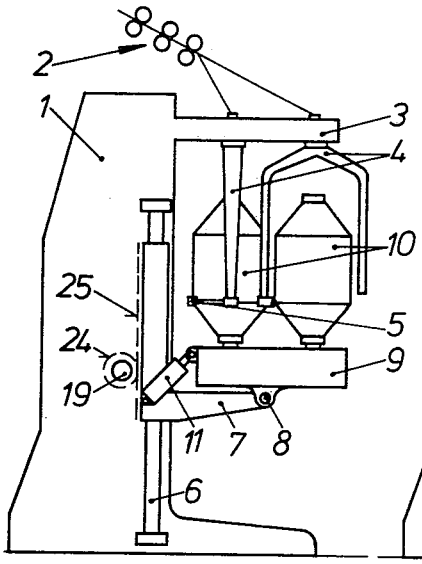
FIG. 1 is a substantially schematic, cross-sectional view through a flyer spinning frame, wherein only those parts necessary for an understanding of the present invention are shown in the position which they assume after the winding of the bobbin is completed.

Referring now to FIGS. 1–4, there is shown a schematic view of the machine stand 1 of a flyer spinning frame of conventional type, which will therefore not be shown and described in every detail. Above the machine stand 1, in bearing brackets (not shown), is disposed a draw frame 2 comprising a plurality of roller pairs. The machine stand 1 has a fixed flyer support or head 3, in which a number of flyers 4 (for example, 80) are rotatably supported at their head in two rows and are driven by drive means (not shown), which may take the form of, for example, pairs of helical gears, via longitudinal shafts. The flyers 4 each have a hollow flyer arm, at the lower end of each of which a spring finger 5 is pivotably supported.

Guided vertically in a straight line on a guide 6 in the machine stand 1 is a cantilever 7, on which a bobbin rail 9 is tiltably supported at the pivot point 8. Bobbins 10 are rotatably supported on bobbin spindles in this bobbin rail 9, coaxial with the flyers 4, and are driven via longitudinal shafts by drive means (not shown), which may take the form of, for example, pairs of helical gears.

Articulated on the cantilever 7 on the one hand and the bobbin rail 9 on the other are several telescoping cylinders 11 or other generally familiar hydraulic or pneumatic functional elements distributed over the length of the bobbin rail, by means of which the bobbin rail 9 can be tilted by about 40° out of its horizontal position and away from the machine stand 1.

It will be appreciated that the flyer spinning frame also has a number of other units, such as control devices; gears for the drive of the flyers 4, of the draw frame 2 and of the bobbins 10 whose rotational speed is variable; weight equalizers for the bobbin rail 9; thread supply frames; thread monitors; suction devices; and so forth. However, these units are not only well known but are not necessary for the understanding of the present invention and are therefore not discussed herein.

Figure 5:
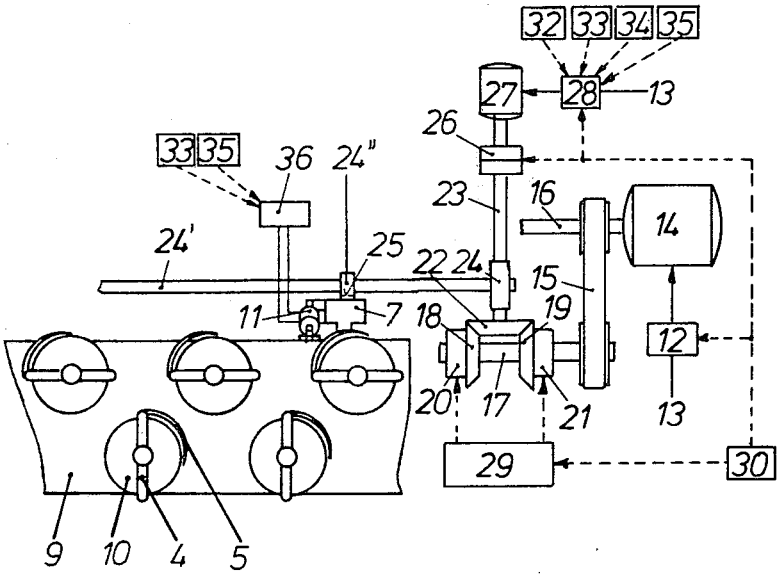
FIG. 5 is a plan view of a detail of the bobbin rail in a position corresponding to FIG. 1, showing the drive and control devices.
Figure 6:
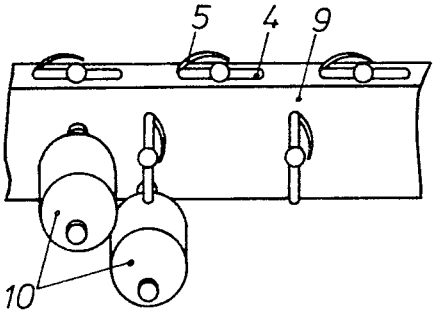
FIG. 6 is a plan view of a detail of the bobbin rail in a position corresponding to FIG. 3 or 4.

From FIG. 5 it may be understood that a primary drive electromotor 14 of the flyer spinning frame, supplied with current via a relay 12 from a grid power supply 13 drives a primary shaft 16 of the flyer spinning frame and the input shaft 17 of a reversing gear via a belt-type back gear 15 with an interposed infinitely adjustable gear (not shown here). Two bevel gears 18 and 19 are loosely rotatable on the input shaft 17, but they can be connected in alternation with the input shaft 17 upon rotation by means of electromagnetically actuatable couplings 20 and 21.

Meshing with the bevel gears 18 and 19 is a further bevel gear 22 on a shaft 23, on which a screw which engages a helical gear 24 is also disposed. The helical gear 24 is disposed on a longitudinal shaft 24' which extends over virtually the entire length of the flyer spinning frame and has pinions 24'' which mesh with toothed areas 25 on the cantilevers 7 supporting the bobbin rail 9. An auxiliary electromotor 27 can also be connected with the shaft 23 by means of a coupling 26. This electromotor 27 is supplied with current via a relay 28 from the grid power supply 13. The elements 17–27 comprise the drive apparatus for moving the bobbin rail 9 up and down.

The reversal in the direction of movement of the bobbin rail 9 during the application of the winding is effected by means of a conventional switching device 29 (not described in detail here), which alternatively actuates the couplings 20 and 21.

A final shutoff switch 30, in a manner to be described further below, affects the relay 12, the switching device 29, the coupling 26 of the electromotor 27, and the electromotor 27 itself. The signals entering the system from switching devices 32–35 are processed, in a manner which is also to be described further below, and control the auxiliary electromotor 27 and a valve 36 for the purpose of acting upon the functional elements or cylinders 11.

The switching devices 32–35 are disposed in such a fashion that (a) one switching device 32 (FIG. 2) is actuated by the bobbin rail 9, when the bobbin rail 9 has reached its lowermost position;

(b) one switching device 33 (FIG. 3) is actuated by the bobbin rail 9 in its outwardly tipped position;

(c) one switching device 34 (FIG. 4) is actuated by the cantilever 7 or the bobbin rail 9 in the position provided for pulling off the bobbin; and (d) one switching device 35 (FIG. 4) can be actuated by the operator.

While the winding is being applied, the switching device 29 controls the couplings 20 and 21 of the reversing gear 18, 19, 22 in such a way that the roving, supplied to the draw frame 2 from thread supply cannisters (not shown) via a grid and delivered thereto in drafted form, is wound up on the rotating bobbins 10 in parallel, cylindrical layers growing gradually shorter, by means of the upward and downward movement of the bobbin rail 9 relative to the rotating flyers 4 which remain locally stationary.

When the bobbin winding has been completed (FIG. 1), the final shutoff switch 30 initiates the bobbin exchanging process by actuating the relay 12 for shutting off the primary motor 14, by initiating the switching device 29 to open both couplings 20 and 21, by closing the coupling 26 at the auxiliary electromotor 27, and by switching on this auxiliary electromotor 27. At the same time, this final shutoff switch 30 can switch on the apparatuses, known per se and not shown here, by means of which the reserve supply of roving is created at the head of the flyers, the infinitely adjustable gear is set back into its initial position, and the flyers are rotated into the position most suitable for the application of the rovings onto the empty tubes.

Figure 2:
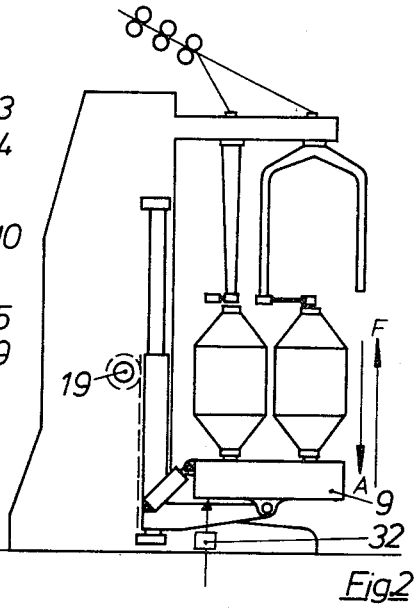
FIG. 2 is a cross-sectional view corresponding to FIG. 1 after the bobbin rail has been lowered into its lowermost position.

The auxiliary electromotor 27 rotates the longitudinal shaft 24' in such a manner that the bobbin rail 9 is lowered (FIG. 2, arrow A). When it has reached a position in which it can be tipped forward without being hindered by the flyers, the switching device 32 is actuated, which shuts off the auxiliary electromotor 27. The machine remains in this position until the operator actuates the switching device 35.

Figure 3:
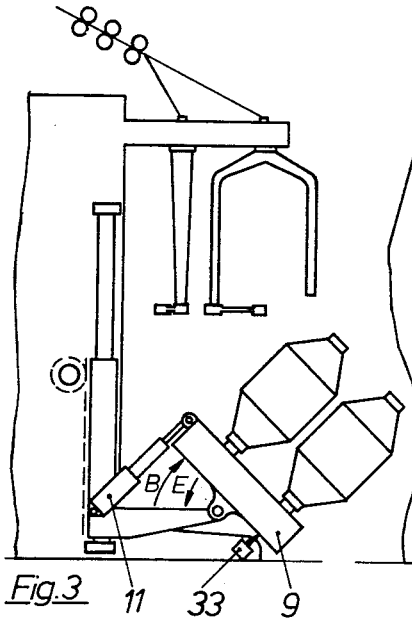
FIG. 3 is a cross-sectional view corresponding to FIG. 2 after the bobbin rail has been tipped.
Figure 4:
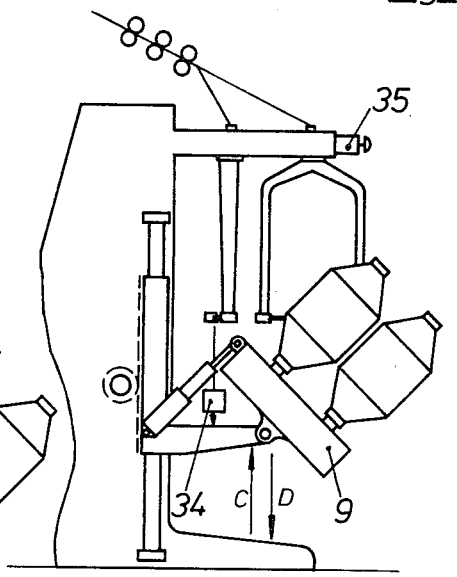
FIG. 4 is a cross-sectional view corresponding to FIG. 3 after the bobbin rail has been raised into the position intended for removing the filled bobbins and placing the empty tubes on the spindles.

When the operation in accordance with the invention is to be resumed, the operator actuates the switching device 35, reverses the valve 36 for actuating the functional elements or cylinders 11, causing the bobbin rail 9 to tip forward (FIG. 3, arrow B). When the bobbin rail 9 reaches its outwardly tipped position (FIG. 3), it then actuates the switching device 33, which switches on the auxiliary electromotor 27 for the purpose of raising the bobbin rail 9 (FIG. 4, arrow C). When the bobbin rail 9 has reached the intended position for pulling off the bobbins, it actuates the switching device 34, which shuts off the auxiliary electromotor 27. The level of this position for pulling off the bobbins may be determined by the arrangement of the switching device 33 and may be selected to suit particular circumstances.

Now the operator can pull off the filled bobbins and place the empty tubes on the spindles in a comfortable position. Then he actuates the switching device 35, which then switches on the auxiliary electromotor 27 in order to lower the bobbin rail 9 (arrow D). When it has reached its lowermost position (FIG. 3), it activates the switching device 33 again, which stops the auxiliary electromotor 27 and reverses the valve 36 for tipping the bobbin rail inward (arrow E) by means of the functional elements or cylinders 11.

When the bobbin rail 9 has reached the inwardly tipped position (FIG. 2), it again actuates the switching device 32, which again switches on the auxiliary electromotor 27 in order to raise the bobbin rail 9 into the position for bobbin winding (arrow F). In the position of the bobbin rail 9 intended for bobbin winding, the auxiliary electromotor 27 is shut off. After applying the roving threads onto the empty tubes, the operator actuates the switch for turning on the machine and thus causes the machine to start. The bobbin exchanging process is thus ended.

It is apparent that the switching devices 32–35 upon actuation, depending upon the position of the parts during the carrying out of the method of the invention, furnish various different switching commands. This requires a logic-type interconnection of the various switching elements and the elements which are affected by them. The arrangement of a logic circuit of this kind is familiar to every person skilled in the art and will therefore not be described in detail here.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An apparatus for changing bobbins in flyer spinning frames having locally stationary, rotatably suspended flyers, a bobbin rail having spindles supported on said frame for both tilting and up and down movements and bobbins rotatably supported on said tiltable bobbin rail, reversible drive means for moving said bobbin rail up and down, means for tipping said bobbin rail outwardly from said frame, control means for reversing the driving direction of said drive means, a plurality of switching devices operatively associated with said drive means, said plurality of switching devices including a switching device actuatable in a position for tipping said bobbin rail outwardly of said spinning frame for operatively conditioning said drive means to raise said bobbin rail, a switching device actuatable in a position of said bobbin rail for removal of said bobbins and for operatively conditioning said drive means to stop further movement of said bobbin rail, and a manually operative switching device actuated by an operator after the removal of the filled bobbins and placing the empty tubes on the spindles for operatively conditioning said drive means to lower said bobbin rail.

2. An apparatus in accordance with claim 1, wherein said flyers include freely pivotable spring fingers and including drive means for said flyers and an inching device for switching on and off said flyer drive means in said bobbin rail lower position whereby said flyers remain in a position which does not hinder the bobbin removal operation and said spring fingers are pivoted toward the axes of said flyers.

3. An apparatus in accordance with claim 1, wherein said bobbin rail tipping means includes at least one controllable, automatic functional element for tipping said bobbin rail outwardly and inwardly of said spinning frame.

4. An apparatus in accordance with claim 3, including a switching device actuated upon the attainment of said lower position by the bobbin rail for actuating said functional element for tipping said bobbin rail outwardly and that said switching device which is actuated upon attainment of the lower position of said bobbin rail in the tipped position is arranged to actuate said functional element for tipping the bobbin rail inwardly.

5. A method of changing bobbins in flyer spinning frames having a head and locally stationary, rotatable suspended flyers, a bobbin rail having spindles supported on said frame for both tilting and up and down movements and bobbins rotatably supported on said tiltable bobbin rail, comprising the steps of:

moving said bobbin rail down by a reversibly driving means, when said bobbins are filled, selectively actuating a plurality of switching devices for tilting said bobbin rail outwardly of said spinning frame and for operatively conditioning said drive means to raise said bobbin rail, tilting said bobbin rail outwardly from said frame by a bobbin rail tilting means, moving said bobbin rail up by said reversibly driving means, actuating a switching device in a position of said bobbin rail for removal of said bobbins and for operatively conditioning said drive means to stop further movement of said bobbin rail, removing the filled bobbins and placing empty bobbins on the spindles, actuating a manually switching device for operatively conditioning said drive means to lower said bobbin rail, tilting said bobbin rail inwardly to said frame by said bobbin rail tilting means, moving said bobbin rail up to a starting position by said reversibly driving means.

6. The method in accordance with claim 5, including the steps of:

switching an inching device on and off while said flyer drive means is in said lower position of said bobbin rail so flyers having freely pivotable spring fingers are in a position whereby said spring fingers are pivoted toward the axes of said flyers and remain in a position which does not hinder the bobbin removal operation.

7. The method in accordance with claim 5, including the steps of:

tipping said bobbin rail outwardly and inwardly of said spinning frame by means of said bobbin rail tipping means including at least one controllable, automatic functional element.

8. The method in accordance with claim 7, including the steps of:

actuating a switching device upon attainment of said lower position by the bobbin rail and actuating said functional element for tipping said bobbin rail outwardly, and actuating said functional element for tipping the bobbin rail inwardly.

* * * * *